US007831176B2

(12) United States Patent
Ishida

(10) Patent No.: US 7,831,176 B2
(45) Date of Patent: Nov. 9, 2010

(54) IMAGE FORMING APPARATUS WITH RESIDUAL TONER TRANSFER FEATURE

(75) Inventor: Yusuke Ishida, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 251 days.

(21) Appl. No.: 11/758,282

(22) Filed: Jun. 5, 2007

(65) Prior Publication Data

US 2007/0292152 A1 Dec. 20, 2007

(30) Foreign Application Priority Data

Jun. 9, 2006 (JP) ..... 2006-161001

(51) Int. Cl.
*G03G 21/00* (2006.01)

(52) U.S. Cl. ..... 399/128; 399/149; 399/44

(58) Field of Classification Search ..... 399/128, 399/129, 149, 150
See application file for complete search history.

(56) References Cited

U.S. PATENT DOCUMENTS

| | | | | |
|---|---|---|---|---|
| 6,421,512 | B2 | 7/2002 | Watanabe et al. | |
| 6,744,994 | B2 * | 6/2004 | Yoshikawa et al. | 399/44 |
| 6,952,546 | B2 | 10/2005 | Yoshikawa | 399/129 |
| 2005/0169668 | A1 * | 8/2005 | Koichi et al. | 399/149 |

FOREIGN PATENT DOCUMENTS

| | | | |
|---|---|---|---|
| JP | 2000-47545 | A | 2/2000 |
| JP | 2000-81738 | A | 3/2000 |
| JP | 2001-215798 | A | 8/2001 |
| JP | 2001-215799 | A | 8/2001 |
| JP | 2004-117960 | | 4/2004 |

* cited by examiner

*Primary Examiner*—David M Gray
*Assistant Examiner*—Roy Yi
(74) *Attorney, Agent, or Firm*—Fitzpatrick, Cella, Harper & Scinto

(57) ABSTRACT

An image forming apparatus is constituted by a rotatable image bearing member; a charging member for electrically charging the image bearing member in contact with the image bearing member; developing member, containing polishing particles, for collecting toner from the image bearing member and effecting development on the basis of an electrostatic latent image formed on the image bearing member; a transfer member for transferring a toner image formed on the image bearing member onto a transfer material; an auxiliary charging member, located downstream from a transfer portion and upstream from the charging member with respect to a movement direction of the image bearing member, for electrically charging toner remaining on the image bearing member after the transfer by contact with the image bearing member; and control means for performing a discharging mode, for discharging polishing particles from the auxiliary charging member onto the image bearing member on the basis of an image ratio of an image to be formed, during non-image formation by applying a voltage to the auxiliary charging member under a condition different from a condition for applying a voltage to the auxiliary charging member during image formation.

6 Claims, 11 Drawing Sheets

IMAGE FORMING APPARATUS WITH RESIDUAL TONER TRANSFER FEATURE

FIELD OF THE INVENTION AND RELATED ART

The present invention relates to an image forming apparatus, such as a copying machine or a laser beam printer, in which transfer residual toner remaining on an image bearing member such as a photosensitive member or the like after a toner image formed on the image bearing member according to electrophotography is transferred onto a transfer material is collected by a developing device.

An image forming apparatus using electrophotography such as a copying machine, a printer, or a facsimile apparatus have generally included an electrophotographic photosensitive member as an image bearing member of a rotation drum and a charging apparatus for electrically charging the photosensitive member uniformly to a predetermined polarity and a predetermined potential (charging step). The image forming apparatus further includes an exposure apparatus as an information writing means for forming an electrostatic latent image on the electrically charged photosensitive member (exposure step), a developing apparatus for developing the electrostatic latent image formed on the photosensitive member with toner as a developer to form a visualized developer image (toner image) (developing step), a transfer apparatus for transferring the toner image from a surface of the photosensitive member onto a recording material such as paper (transfer step), a cleaning apparatus for removing toner remaining in some amount on the photosensitive member after the transfer step (residual developer or transfer residual toner) to clean the recording material surface (cleaning step), and a fixing apparatus for fixing the toner image on the recording material (fixing step). The photosensitive member is repetitively subjected to an electrophotographic process (charging step, exposure step, developing step, transfer step, cleaning step, and fixing step) to form an image.

The toner remaining on the photosensitive member after the transfer step is removed from the surface of the photosensitive member by the cleaning apparatus and collected in the cleaning apparatus as waste toner. However, from the viewpoints of environmental protection and effective use of resources, it is desirable that the waste toner is not produced.

For this reason, an image forming apparatus in which transfer residual toner (so-called waste toner) collected by a cleaning apparatus is collected by a developing apparatus and then utilized again has been proposed.

Further, Japanese Laid-Open Patent Application (IP-A) 2004-117960 has proposed a cleanerless image forming apparatus wherein a cleaning apparatus is omitted and transfer residual toner on a photosensitive member after a transfer step is removed and collected from the photosensitive member by a developing apparatus and utilized again.

The cleaner less cleanerless image forming apparatus employs a cleanerless method in which transfer residual toner present at a portion (non-image portion) which is not intended to be developed is removed and collected in the developing apparatus by a fog-removing bias when the transfer residual toner remaining on the photosensitive member after the transfer step passes through a spacing between the developing apparatus and the photosensitive member. The fog-removing bias is a fog-removing potential difference Vback between a DC voltage applied to the developing apparatus and a surface potential of the photosensitive member.

According to the cleanerless method, the transfer residual toner is collected in the developing apparatus and utilized again for developing an electrostatic latent image in a subsequent step or later, so that the waste toner can be eliminated or reduced and a maintenance operation can also be reduced. Further, in the cleanerless method, the surface of the photosensitive member is not abraded by a cleaner, so that a thickness of a surface layer of the photosensitive member is kept at a constant level to ensure an increase in life-span of the photosensitive member. The cleanerless method is also advantageous for downsizing of the image forming apparatus.

In the cleanerless image forming apparatus, in the case where a contact charging apparatus for electrically charging the surface of the photosensitive member by contact with the photosensitive member is used as the charging apparatus, toner can be contained in the contact charging apparatus. More specifically, when the transfer residual toner on the photosensitive member passes through a contact nip (charging portion) between the photosensitive member and the contact charging apparatus, a part of the transfer residual toner, particularly toner which has been reversely charged to an opposite polarity (positive) to a normal polarity (negative) as a charge polarity is contained in the contact charging apparatus. As a result, the contact charging apparatus is contaminated with the toner at a level exceeding an acceptable range to cause charging failure.

In the toner as the developer, positively charged toner having a polarity opposite to the normal charge polarity of the toner is contained in mixture although an amount thereof is small. Further, even the negatively charged toner having the normal charge polarity can be reversely charged by the influence of a transfer bias or separation electric discharge or reduced in an amount of electric charge by electric charge removal. For this reason, the transfer residual toner contains the normally charged toner, the reversely charged toner, and toner having a small charge amount in mixture. The reversely charged toner or the toner having the small charge amount in the transfer residual toner is deposited in the contact charging apparatus when the transfer residual toner passes through the contact nip (charging portion) between the photosensitive member and the control charging apparatus.

In order to collect the transfer residual toner by the developing apparatus, the charge polarity of the transfer residual toner, on the photosensitive member, which is carried to the developing portion after passing through the charging portion is required to be the normal charge polarity. In addition, the charge amount of the transfer residual toner is required to be a charge amount of toner capable of developing the electrostatic latent image on the photosensitive member by the developing apparatus.

The reversely charged toner and toner having an improper charge amount cannot be removed and collected from the photosensitive member to the developing apparatus, thus leading to a defective image.

In order to prevent the toner from depositing in the contact charging apparatus, the charge polarities of the transfer residual toner containing the normally charged toner, the reversely charged toner, and the toner having the small charge amount in mixture which are carried on the photosensitive member from the transfer portion to the charging portion are required to be uniform to have the normal charge polarity.

For this reason, in a movement direction of the photosensitive member, a downstream-side auxiliary charging member for electrically charging the transfer residual toner by applying thereto a voltage of an opposite polarity to the normal polarity of the toner has been conventionally provided in contact with the photosensitive member surface at a position upstream from a primary charging member and downstream from a transfer means. At a position upstream from the downstream-side auxiliary charging member and downstream from the transfer means, an upstream-side auxiliary charging member for applying a voltage of the opposite polarity to the normal polarity of the toner has been provided in contact with the photosensitive member surface. By applying a certain DC voltage to these downstream-side and upstream-side auxiliary charging members, the above-described problem has been solved (e.g., JP-A 2001-215798 and JP-A 2001-215799).

More specifically, the transfer residual toner remaining on the photosensitive member after the transfer is positively charged by the upstream side auxiliary charging member and the positively charged transfer residual toner is electrically charged to the normal polarity by the downstream-side auxiliary charging member. Thereafter, the surface of the photosensitive member is electrically charged by the contact charging apparatus and at the same time, the transfer residual toner which has been electrically charged by the upstream-side auxiliary charging member is electrically charged to have an amount of electric charge suitable for removal and collection by the developing apparatus through simultaneous developing and cleaning, thus being collected by the developing apparatus.

It has been known that an electric discharge product generated due to the presence of high-voltage members such as the charging member and the transfer member in the image forming apparatus is deposited at the surface of the image bearing member to constitute a contaminant and the contaminant lowers an electric resistance at the surface of the image bearing member particularly in a high-humidity environment and prevents formation of a clear electrostatic latent image to cause deterioration in image quality (image flow). Examples of a factor causing the occurrence of such image flow may include nitrate ions and the like as the discharge product generated by the electric discharge. The discharge product deposits at the surface of the photosensitive member as the image bearing member, thus forming a thin film on the photosensitive member surface. This thin film takes up moisture in the high-humidity environment to lower the electric resistance at the photosensitive member surface, thus preventing formation of the clear electrostatic latent image. As a result, the thin film leads to the deterioration in image quality. The image flow problem is solved by mounting a heater (drum heater) to the photosensitive member. However, the mounting of the drum heater increases a production cost of the image forming apparatus.

Further, the image flow can be prevented by a method of removing the discharge product by rubbing the photosensitive member surface. However, in the case of the above-described cleanerless method, the image forming apparatus does not include the cleaning apparatus for rubbing the photosensitive member, so that it is difficult to remove the electric discharge product.

In a constitution described in JP-A 2000-47545, a method of removing an electric discharge product at the surface of a photosensitive member by storing polishing particles in a cleaning apparatus is applied. More specifically, the above-described auxiliary charging means is caused to contact the photosensitive member and the polishing particles for polishing the photosensitive member surface are contained in mixture with a developer in a developing apparatus. Then, it can be considered that the polishing particles are contained in the auxiliary charging means from the developing apparatus through the photosensitive member to remove the discharge product.

The polishing particles have an opposite polarity to the charge polarity of the toner (e.g., a positive charge polarity in the case where the toner has a negative charge polarity), so that the polishing particles are subjected to development at a white background portion (at a fog removing bias Vback) and are not transferred due to the opposite polarity to the charge polarity of the toner, thus being collected by the auxiliary charging means.

JP-A 2000-081738 discloses a constitution in which a large amount of electroconductive particles for being deposited on a charging roller to assist an electric charging function are supplied when an image forming ratio is increased. As a result, compared with the case where electrically charging particles are always supplied continuously, excess and deficiency of the amount of the electroconductive particles supplied to the charging roller are prevented.

In the case of the conventional image forming apparatus using the cleaning apparatus, the image flow was prevented by supplying the polishing particles to a cleaner member in a single-directional manner to be stored in the cleaner member.

However, in the cleanerless method, when the polishing particles are supplied single-directionally, the polishing particles cannot be completely collected by the auxiliary charging means. As a result, the polishing particles contaminate the charging member and the photosensitive member, so that charging failure can lead to image failure such as streak images. This is a phenomenon occurring in the case where formation of an image having a low toner print ratio (Low duty image) is successively performed many times.

In the case where a large amount of transfer residual toner is produced, the transfer residual toner removes the polishing particles from the auxiliary charging member, so that the polishing particles for the auxiliary charging member (brush) is depleted to cause an occurrence of image flow. This is a phenomenon occurring in the case where formation of an image having a high print ratio (high duty image) is successively performed many times.

SUMMARY OF THE INVENTION

A principal object of the present invention is to prevent supersaturation of an amount of polishing particles accumulated on an auxiliary charging member depending on a ratio of an image to be formed.

An object of the present invention is to provide an image forming apparatus capable of preventing the supersaturation of the amount of the polishing particles.

According to an aspect of the present invention, there is provided an image forming apparatus comprising:

a rotatable image bearing member;

a charging member for electrically charging the image bearing member in contact with the image bearing member;

developing means for collecting toner from the image bearing member and effecting development on the basis of an electrostatic latent image formed on the image bearing member, the developing means containing polishing particles;

a transfer member for transferring a toner image formed on the image bearing member onto a transfer material;

an auxiliary charging member, located downstream from a transfer portion and upstream from the charging member with respect to a movement direction of the image bearing member, for electrically charging toner remaining on the image bearing member after the transfer by contact with the image bearing member; and control means for performing a discharging mode, for discharging polishing particles from the auxiliary charging member onto the image bearing member on the basis of an image ratio of an image to be formed, during non-image formation by applying a voltage to the auxiliary charging member under a condition different from a condition for applying a voltage to the auxiliary charging member during image formation.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinbelow, the image forming apparatus according to the present invention will be described more specifically with reference to the drawings.

Embodiment 1

(1) General Constitution of Image Forming Apparatus

First, general collection and operation of the image forming apparatus in this embodiment will be described.

Figure 1:
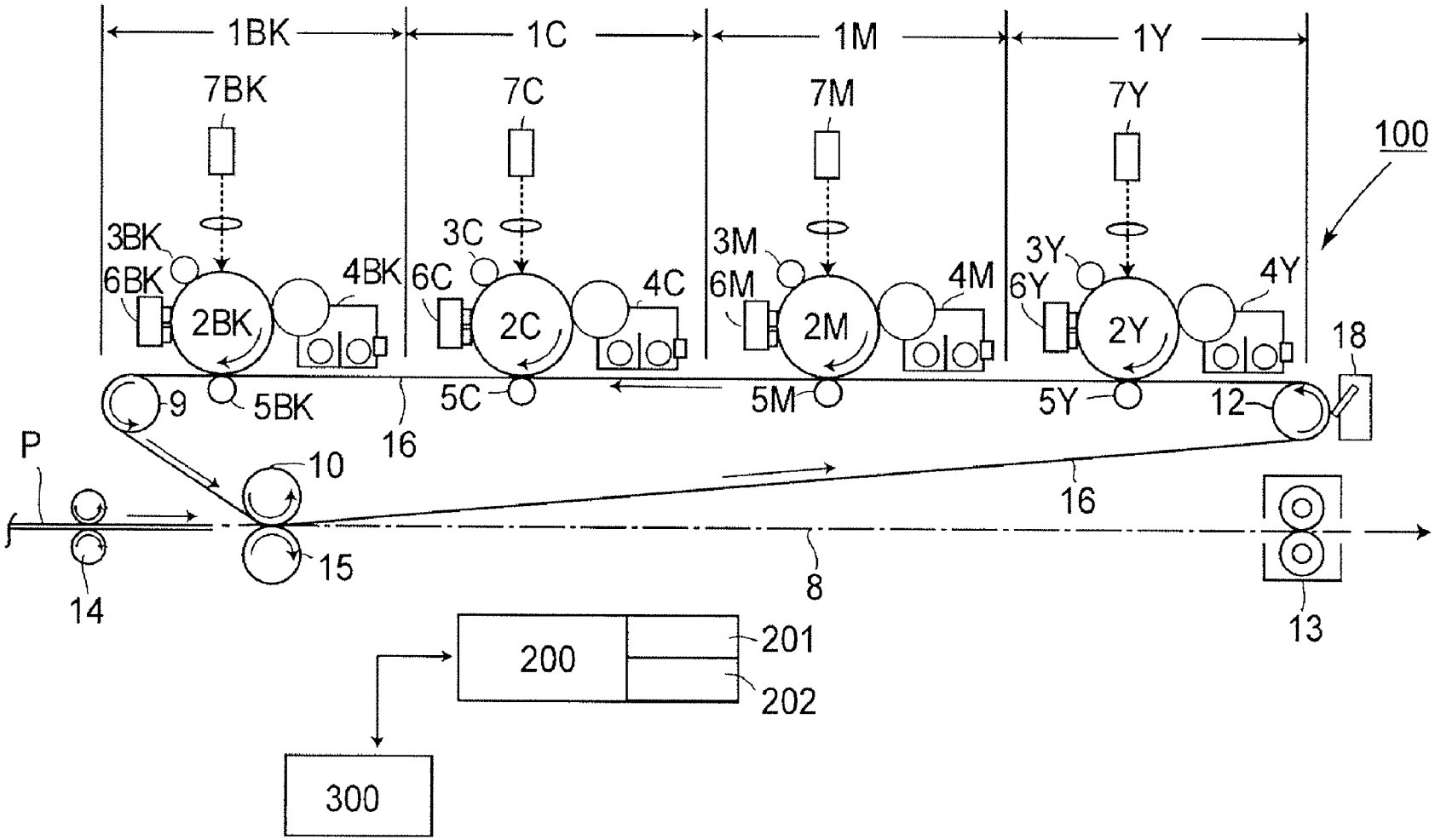
FIG. 1 is a schematic constitutional view of an embodiment of an image forming apparatus to which the present invention is applied.

FIG. 1 is a schematic constitutional view of an image forming apparatus 100 of this embodiment. The image forming apparatus 100 is an electrophotographic full-color printer including first to fourth image forming portions 1Y, 1M, 1C and 1Bk for forming images of yellow (Y), magenta (M), cyan (C) and black (Bk), respectively. More specifically, the image forming apparatus 100 is capable of forming a four-color based full-color image on a recording material P depending on an image signal inputted from a host apparatus 300, such as an original reading apparatus or a personal computer, connected to a main assembly of the image forming apparatus 100 into a control circuit portion (control means) 200. The recording material P may be a recording sheet, a plastic film, a cloth, etc.

The control circuit portion 200 controls an operation of an entire image forming apparatus. More specifically, the control circuit portion 200 executes processing of control signals sent to various process equipment and information signals inputted from the process equipment and control of an image forming sequence in accordance with a control program, a reference table, data, and the like is stored in a storing portion (ROM or RAM) 201.

The first to fourth image forming portions 1Y, 1M, 1C and 1Bk are disposed in a tandem arrangement from right to left sides in FIG. 1. At the image forming portions, on electrophotographic photosensitive members 2Y, 2M, 2C and 2Bk as image bearing members, toner images of yellow, magenta, cyan and black are formed, respectively. The thus formed respective color toner images on the photosensitive members at the image forming portions are primary-transferred successively onto an intermediary transfer belt 16 as a primary recording medium in a superposition manner and then are secondary-transferred onto the recording material P as a secondary recording medium.

Each of the four (first to fourth) image forming portions 1Y, 1M, 1C and 1Bk has a substantially identical constitution except for a difference in developing color and is an electrophotographic image forming mechanism of a laser scanning exposure type. In the following, in the case where these image forming portions are not required to be particularly distinguished from each other, symbols Y, M, C and Bk for members or means for the respective image forming portions are omitted and the members or means will be collectively described.

Figure 2:
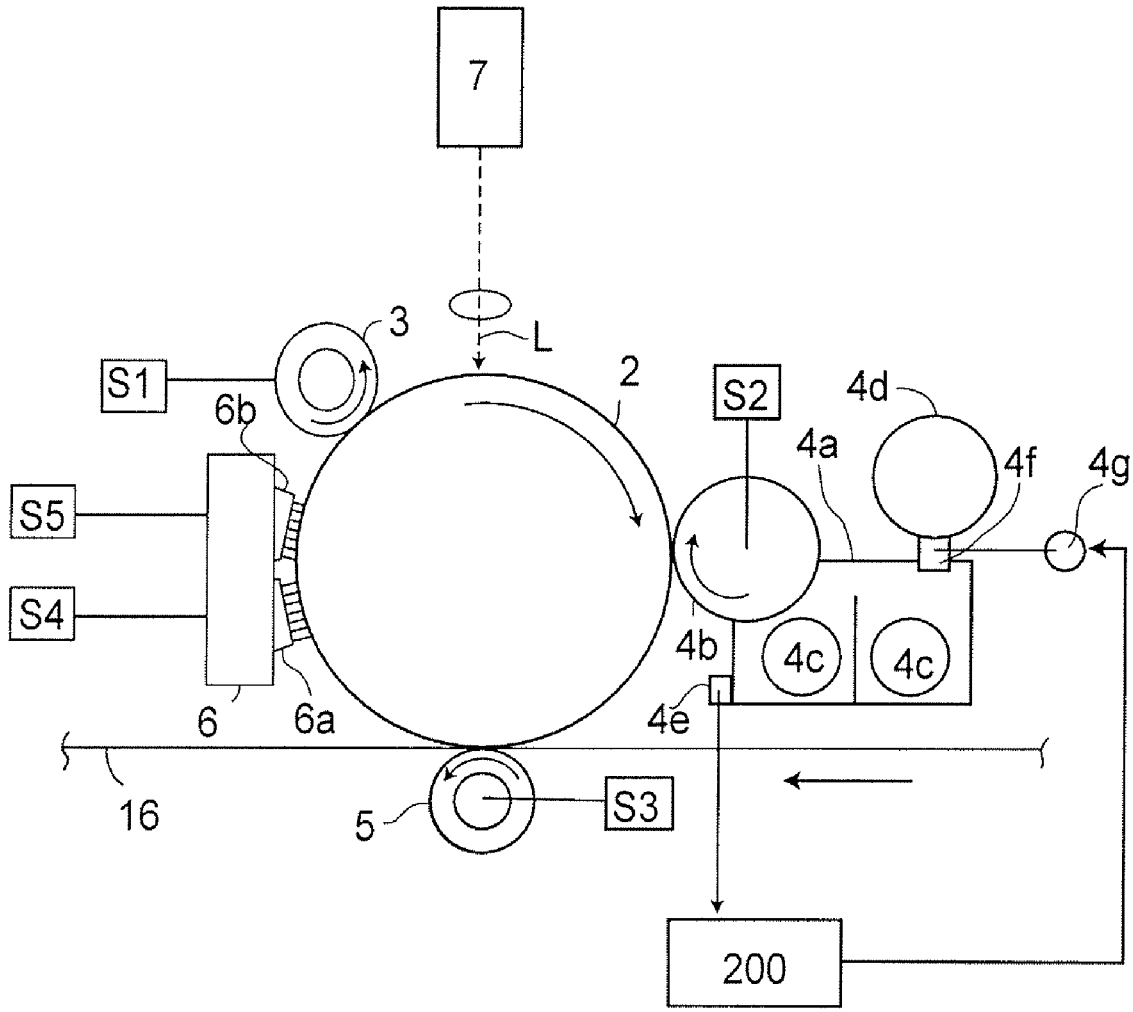
FIG. 2 is a schematic view for illustrating a cleanerless system of the image forming apparatus according to the present invention.

FIG. 2 is an enlarged view showing one of the image forming portions shown in FIG. 1.

At an image forming portion 1, a cylindrical photosensitive member 2 as an image bearing member (hereinafter referred to as a "drum"). The drum 2 is rotationally driven at a predetermined speed in a direction indicated by an arrow. Around the drum 2, members including a charging roller 3 as a charging member, a developing apparatus 4 as a developing means, a primary transfer roller 5 as a transfer member, and an auxiliary charging apparatus 6 as an auxiliary charging member are disposed. Above the drum 2, a laser scanner (exposure apparatus) 7 as an exposure means is disposed. Under the first to fourth image forming portions 1Y, 1M, 1C and 1Bk, the intermediary transfer belt 16 as an intermediary transfer member (hereinafter simply referred to as a "belt") is extended and disposed. In this embodiment, the belt 16 is used as the transfer material but in such a constitution using no belt, the transfer material is the recording material. The belt 16 is a flexible endless belt formed of a dielectric material and is extended around three rollers including a drive roller 9, a secondary transfer opposite roller 10, and a turn roller 12 functioning also as a tension roller. The belt 16 is rotationally driven by the drive roller 9 at the substantially same speed as the rotation speed of the drum 2 in a counterclockwise direction indicated by an arrow. The belt 16 is pressed against a lower surface of the drum 2 by the primary transfer roller 5 at each image forming portion. A contact portion between the belt 16 and the drum 2 is a primary transfer portion. Further, a secondary transfer roller 15 as a secondary transfer member is pressed against the secondary transfer opposite roller 10 through the belt 16. A contact portion between the secondary transfer roller 15 and the belt 16 is a secondary transfer portion. The recording material P is separated and fed one-by-one from an unshown sheet feeding portion (recording material accommodation cassette) at a predetermined control timing to be introduced into the secondary transfer portion at a predetermined control timing by a registration roller pair. The recording material P coming out of the secondary transfer portion passes through a sheet path 8 to be introduced into a fixing apparatus 13.

Four-color based full-color image formation will be described. When an image forming operation is started, at each of the image forming portions, the surface of the rotating drum 2 is electrically charged uniformly to a predetermined polarity and a predetermined potential at a charging portion by the charging roller 3. To the charging roller 3, a predetermined charging bias is applied from a power source S1. With respect to the electrically charged surface of the drum 2, a scanning exposure with a laser light L modulated in correspondence with an image signal is effected at an exposure portion by the exposure apparatus 7 as the exposure means. As a result, an electrostatic latent image corresponding to the image signal is formed on the drum 2. The electrostatic latent image is developed (visualized) at a developing portion with toner of a developer contained in the developing apparatus 4 to provide a visible image (toner image). In this embodiment, a reverse developing method in which toner is deposited at a portion exposed to the laser light L (light part potential) is used. To a developing sleeve 4*b* of the developing apparatus 4, a predetermined developing bias is applied from a power source S2.

The toner image formed on the drum 2 is primary-transferred onto the belt 16 at the primary transfer portion. To the primary transfer roller 5, a predetermined primary transfer bias is applied from a power source S3. After the primary transfer, toner remaining on the drum surface (transfer residual toner) is conveyed to the developing portion after passing through drum rubbing portions of a first auxiliary charging means 6*a* (auxiliary charging member) and a second auxiliary charging means 6*b* (auxiliary charging member) of the auxiliary charging apparatus 6, the charging portion, and the exposure portion by further rotation of the drum 2. Then, at the developing portion, the transfer residual toner is removed and collected by simultaneous developing and cleaning by means of the developing apparatus 4 (cleanerless system).

The above described above-described image forming operation is successively performed at a predetermined control timing at the first to fourth image forming portions 1Y, 1M, 1C and 1Bk to successively superpose the four color toner images of yellow, magenta, cyan and black, thus effecting primary transfer of the toner images. As a result, an unfixed four-color based full-color toner image (mirror image) is formed on the belt 16.

The unfixed full-color toner image formed on the belt 16 is conveyed to the secondary transfer portion by further rotation of the belt 16. By introducing the recording material P at a predetermined control timing into the secondary transfer portion, the unfixed full-color toner image (four color toner images) on the belt 16 surface is secondary-transferred collectively onto the surface of the recording material P. To the secondary roller 15, a predetermined secondary transfer bias is applied from an unshown power source.

Then, the recording material P is separated from the belt 16 and introduced into the fixing apparatus 13 through the sheet path 8. By the fixing apparatus 13, the toner on the recording material P is melted and mixed under application of heat and pressure to result in a permanent full-color toner image. The recording material P coming out of the fixing apparatus 13 is discharged from the image forming apparatus as an image formation product.

Further, the toner which has not been completely transferred at the secondary transfer portion and remains on the belt 16 is removed by a belt cleaner 18. Thus, a series of operations is completed.

It is also possible to form a desired single color image or a desired plurality of color images by using only desired image forming portion(s).

The image forming portion 1 will be described more specifically with reference to FIG. 2.

1) Drum 2

In this embodiment, the drum 2 is an organic photoconductor (OPC) having a negatively chargeable charging characteristic and is rotationally driven in a clockwise direction indicated by an arrow at a predetermined process speed (peripheral speed) of 130 mm/sec with a central shaft having an outer diameter of 30 mm as a center.

2) Charging Roller 3

As the charging means for electrically charging the surface of the drum 2 uniformly, the image forming portion 1 includes the contact charging apparatus (contact charger) 3. In this embodiment, the contact charging apparatus 3 is a charging roller (roller charger) and electrically charges the drum surface by utilizing an electric discharge phenomenon occurring in a minute gap between the charging roller 3 and the drum 2. To the charging roller 3, a charging bias voltage is applied from the power source 51 under a predetermined condition. As a result, the surface of the rotating drum 2 is contact-charged electrically to a predetermined polarity and a predetermined potential. In this embodiment, the charging bias voltage applied to the charging roller 3 is an oscillating voltage in the form of a DC voltage (Vdc) biased with an AC voltage (Vac). More specifically, the charging bias voltage is an oscillating voltage in the form of a DC voltage of −500 V biased with a sinusoidal wave AC voltage having a frequency of 1.3 kHz and a peak-to-peak voltage Vpp of 1.5 kV. By the application of the charging bias voltage, the surface of the drum 2 is electrically charged uniformly to a voltage (dark part potential Vd) of −500 V identical to the DC voltage applied to the charging roller 3.

3) Developing Apparatus 4

In this embodiment, the developing apparatus 4 is a developing apparatus employing a two-component developing method in which development is effected while a magnetic brush of a two-component developer comprising toner and a carrier is caused to contact the drum 2. The developing apparatus 4 includes a developing container 4*a* and a nonmagnetic developing sleeve 4*b* as a developer carrying member. The developing sleeve 4*b* is externally exposed at a part of its outer peripheral surface and disposed in the developing container 4*a*. In the developing sleeve 4*b*, the two-component developer is contained and a magnet roller (not shown) is nonrotationally inserted. The developing container 4*a* contains the two-component developer and on a bottom side of the developing container 4*a*, developer stirring members 4*c* are disposed. Further, toner for supply is contained in a toner hopper 4*d*. The two-component developer in the developing container 4*a* principally comprises nonmagnetic toner and a magnetic carrier in mixture and is stirred by the developer stirring members 4*c*. In this embodiment, the toner comprises colored resin particles containing a binder resin material, a colorant, and other additives as desired. The toner comprises negatively chargeable particles of polyester resin produced through a polymerization method and may preferably have a volume-average particle size of 5 μm or more and 8 μm or less. In this embodiment, the volume-average particle size is 6.2 μm. The toner is negatively charged by rubbing with the magnetic carrier.

As the carrier, e.g., it is possible to suitably use magnetic particles of metals such as surface-oxidized iron, surface-unoxidized iron, nickel, cobalt, manganese, chromium, and rare-earth metals; their alloys; and ferrite oxides. A production method of these magnetic particles is not particularly limited. The carrier may have a weight-average particle size of 20-50 μm, preferably 30-40 μm and a volume resistivity of $10^7$ Ω.cm or more, preferably $10^8$Ω.cm or more. In this embodiment, the carrier used has a volume resistivity of $10^8$ Ω.cm. In this embodiment, as a low-density magnetic carrier, a magnetic resin carrier produced through a polymerization of a mixture of a magnetic metal oxide and a nonmagnetic metal oxide in a phenolic binder resin material at a predetermined mixing ratio is used. The magnetic resin carrier has a volume-average particle size of 35 μm, a true density of 3.6-3.7 g/cm$^3$, and a magnetization of 53 A.m$^2$/kg.

The developing sleeve 4*b* is held and closely disposed opposite to the drum 2 with a closest distance (S-D gap) of 350 μm. An opposite portion between the drum 2 and the developing sleeve 4*b* is the developing portion. The developing sleeve 4*b* is rotationally driven in a direction opposite from the rotation (movement) direction of the drum 2 at the developing portion. BY a magnetic force of the magnetic roller in the developing sleeve 4*b*, a part of the two-component developer in the developing container 4*a* is adsorbed and held by the developing sleeve 4*b* as a magnetic brush layer at the outer peripheral surface of the developing sleeve 4*b*. The magnetic brush layer is rotationally conveyed by the rotation of the developing sleeve 4*b* and appropriately rubs the photosensitive member surface at the developing portion in contact with the surface of the drum 2. To the developing sleeve 4*b*, the predetermined developing bias (voltage) is applied from the power source S2. In this embodiment, the developing bias voltage applied to the developing sleeve 4*b* is an oscillating voltage in the form of a DC voltage (Vdc) biased with an AC voltage (Vac). More specifically, the oscillating voltage is in the form of a DC voltage of −350 V and a rectangular wave AC voltage having a frequency of 8.0 kHz and a peak-to-peak voltage of 1.8 kV.

The surface of the rotating developing sleeve 4*b* is coated with the magnetic brush layer as a thin layer, and the toner in the developer conveyed to the developing portion is selectively deposited corresponding to the electrostatic latent image on the surface of the drum 2 by an electric field generated by the developing bias voltage, so that the electrostatic latent image is developed as a toner image. The developer thin layer on the developing sleeve 4*b* passing through the developing portion is returned to a developer returning portion in the developing container 4*a* by further rotation of the developing sleeve 4*b*.

In order to keep a toner concentration (content) in the two-component developer contained in the developing container 4*a* at a substantially constant level, the toner concentration in the two-component developer is detected by, e.g., an optical toner concentration sensor 4*e*. Electric information about the toner concentration detected by the sensor 4*e* is inputted into the control circuit portion 200. The control circuit portion 200 controls supply of the toner from the toner hopper 4*d* into the developing container 4*a* depending on the toner concentration detection information detected by the sensor 4*e*.

More specifically, when the control circuit portion 200 detects a lowering in toner concentration to a lower limit value in a predetermined concentration range by the toner concentration detection information detected by the sensor 4*e*, the control circuit portion 200 turns on a drive motor 4*g* for a toner supplying screw 4*f* provided to the toner hopper 4*d*. As a result, by the rotation of the screw 4*f*, the toner in the toner hopper 4*d* is supplied into the developing container 4*a* as the need arises. The supplied toner is stirred and mixed in the two-component developer by the stirring member 4*c* to increase the toner concentration in the two-component developer. When the control circuit portion 200 detects an increase in toner concentration to an upper limit value in the predetermined concentration range on the basis of the toner concentration detection information detected by the sensor 4*e*, the control circuit portion 200 turns off the drive motor 4*g* to stop the rotation of the screw 4*f*. As a result, the supply of the toner from the toner hopper 4*d* into the developing container 4*a* is terminated. By such toner supply control, the toner concentration in the two-component developer contained in the developing container 4*a* is kept in a substantially constant range.

Figure 3:
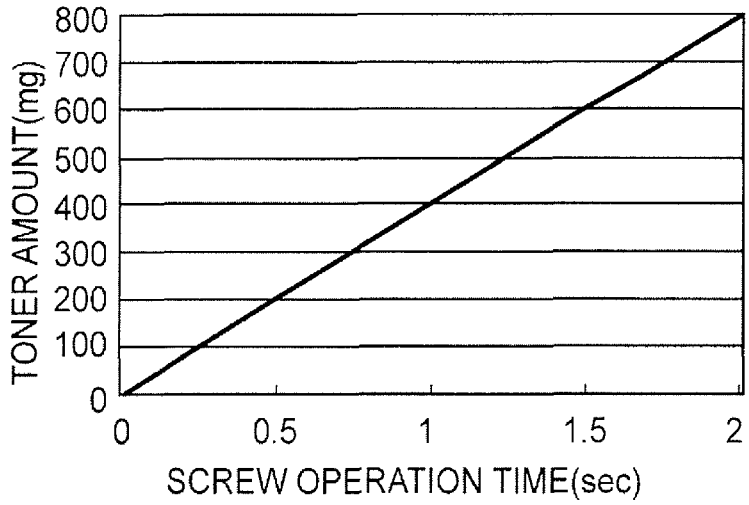
FIG. 3 is a graph showing a relationship between a toner supply screw operation time and an amount of toner supply.

The toner supplying screw 4*f* in this embodiment is designed to supply the toner at a rate of 400 mg/sec (rotation time) as shown in FIG. 3. An amount of the toner supply corresponds to the rotation time of the toner supplying screw 4*f*.

The control circuit portion 200 stores information, (data) about the amount of toner supplied from the toner hopper 4*d* as a toner supply means into the developing container 4*a*, in a storing portion 201 as a storing means.

4) Primary Transfer Roller 5

The primary transfer roller 5 is pressed against the drum 2 through the belt 16 at a predetermined pressing force. To the primary transfer roller 5, a transfer bias of a positive polarity (+2 kV in this embodiment) opposite to a negative polarity as the normal opposite polarity of the toner is applied from the power source S3. As a result, the toner image is successively transferred from the surface of the drum 2 onto the surface of the belt 16.

(2) Cleaner-Less System

The image forming apparatus of this embodiment employs the cleanerless system at each of the image forming portions 1Y, 1M, 1C and 1Bk. That is, each image forming portion is not provided with a dedicated cleaning apparatus for removing transfer residual toner remaining on the surface of the drum 2 in some amount after the toner image is transferred onto the belt 16.

As described above, the transfer residual toner is conveyed to the developing portion after passing through the drum rubbing portions of the first and second auxiliary charging means 6*a* and 6*b* of the auxiliary charging apparatus 6, the charging portion, and the exposure portion by further rotation of the drum 2. Then, at the developing portion, the transfer residual toner is removed and collected by the developing apparatus 4 through the simultaneous developing and cleaning (cleanerless system).

In this embodiment, the developing sleeve 4*b* of the developing apparatus 4 is rotated in the direction opposite from the surface movement direction of the drum 2 at the developing portion as described above. Such a rotation of the developing sleeve 4*b* is advantageous for collection of the transfer residual toner from the drum 2. The transfer residual toner on the drum 2 passes through the exposure portion, so that the exposure step is performed from above the transfer residual toner. An amount of the transfer residual toner is ordinarily small, so that the exposure step is not adversely affected significantly by the transfer residual toner through which the exposure step is performed.

However, as described above, the transfer residual toner contains particles of the normally charged toner, the reversely charged toner, and the less charged toner in mixture. When the particles of reversely charged toner and less charged toner of these toner particles are deposited on the charging roller 3 at the time the particles pass through the charging portion, the charging roller 3 is contaminated with the transfer residual toner at a level exceeding an acceptable level, thus causing charging failure in some cases.

In order to effectively remove and collect the transfer residual toner on the drum 2 by the developing apparatus 4 simultaneously with the developing operation, an amount of electric charge of the transfer residual toner is an important factor. More specifically, the transfer residual toner on the drum 2 carried and conveyed to the developing portion may preferably have a positive charge polarity and a charge amount capable of developing the electrostatic latent image on the drum 2 by the developing apparatus 4. In the cases where the charge polarity of the transfer residual toner is reversed and the charge amount of the transfer residual toner is not appropriate, the transfer residual toner cannot be removed and collected from the drum 2 in the developing apparatus 4 to cause an occurrence of a defective image.

For this reason, as the auxiliary charging means, the auxiliary charging apparatus 6 is disposed downstream from the transfer portion and upstream from the charging portion with respect to the drum rotation direction.

The auxiliary charging apparatus 6 in this embodiment includes the two (first and second) auxiliary charging means 6*a* and 6*b*. The first auxiliary charging means 6*a* is an upstream-side auxiliary charging member for positively charging the transfer residual toner on the drum 2. To the first auxiliary charging means 6*a*, a predetermined charging bias is applied from a power source S4. This charging bias is a (positive) voltage of an opposite polarity to the normal charge polarity of the toner. The second auxiliary charging means 6*b* is disposed at a position downstream from the first auxiliary charging means 6*a* and upstream from the charging portion in the drum rotation direction.

The second auxiliary charging means 6*b* is a downstream-side auxiliary charging member for negatively charging the transfer residual toner to the normal charge polarity of the toner. To the second auxiliary charging means 6*b*, a predetermined charging bias is applied from a power source S5. This charging bias is a (negative) voltage of an identical polarity to the normal charge polarity of the toner.

In this embodiment, each of the two (first and second) auxiliary charging means 6*a* and 6*b* is an electroconductive brush member having a proper electroconductivity and is disposed in contact with the surface of the drum 2 at a brush portion thereof. Hereinafter, the first auxiliary charging means 6*a* is referred to as a first electroconductive brush and the second auxiliary charging means 6*b* is referred to as a second electroconductive brush.

Generally, the transfer residual toner remaining on the drum 2 without being transferred contains the reversely charged toner and the toner having an inappropriate charge amount in mixture. The transfer residual toner is once charge-removed by the first electroconductive brush 6*a* and then is electrically charged again to the normal charge polarity of the toner by the second electroconductive brush 6*b*. As a result, prevention of deposition of the transfer residual toner on the charging roller 3 can be effectively realized and at the same time, removal and collection of the transfer residual toner by the developing apparatus 4 can be performed completely. For this reason, it is also possible to prevent an occurrence of a ghost image of an image pattern of the transfer residual toner.

Figure 4:
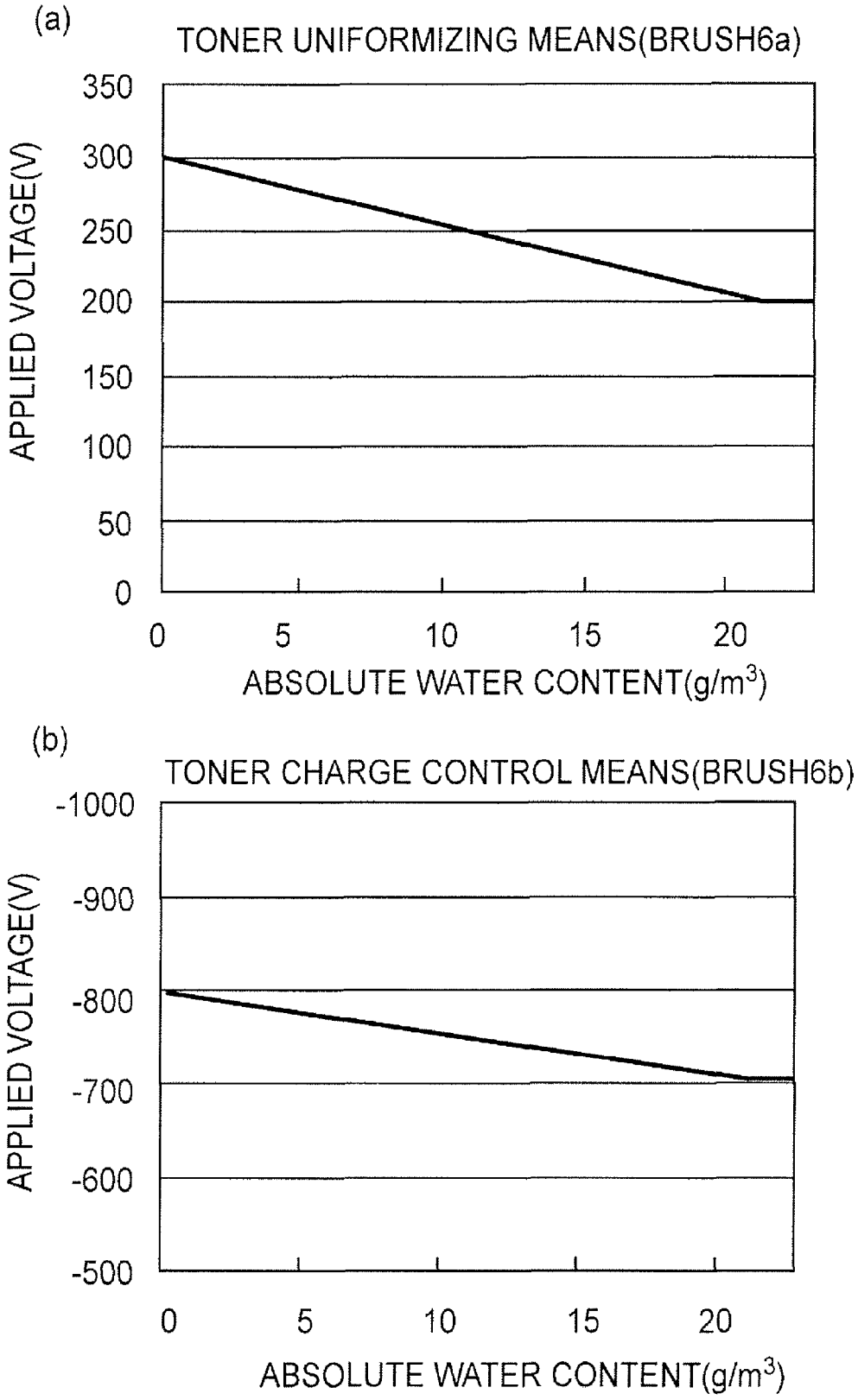
FIG. 4(*a*) is a graph showing a relationship between an absolute water content and a voltage applied to a first electroconductive brush, and FIG. 4(*b*) is a graph showing a relationship between the absolute water content and a voltage applied to a second electroconductive brush.

To the first electroconductive brush 6*a*, a positive DC voltage is applied from the power source S4, and to the second electroconductive brush 6*b*, a negative DC voltage is applied from the power source S5. Values of the DC voltages applied to the respective brushes are changed as shown in FIGS. 4(*a*) and 4(*b*) depending on an absolute water content calculated from a temperature and a relative humidity which are detected by a temperature and humidity sensor (not shown) provided in the image forming apparatus. For example, in an environment of a temperature of 23° C. and an absolute water content of 10.5 g/m$^3$, a voltage of +250 V is applied to the first electroconductive brush 6*a* and a voltage of −750 V is applied to the second electroconductive brush 6*b*.

The transfer residual toner remaining on the drum 2 after the toner image is transferred onto the belt 16 at the transfer portion is conveyed to the contact portion between the first electroconductive brush 6*a* and the drum 2, where the transfer residual toner is uniformed made uniform in charge amount at a value close to 0 μC/g by the first electroconductive brush 6*a*. The thus electrically uniform transfer residual toner on the drum 2 is conveyed to the contact portion between the second electroconductive brush 6*b* and the drum 2, where the charge polarity of the transfer residual toner is made uniform to the negative polarity as the normal charge polarity of the toner. By uniformizing making uniform the charge polarity of the transfer residual toner to the negative polarity as the normal charge polarity of the toner, a mirror force of the transfer residual toner with respect to the drum 2 is increased when the surface of the drum 2 is electrically charged from above the transfer residual toner at the contact portion (charging portion) between the charging roller 3 and the drum 2. As a result, the transfer residual toner is prevented from being deposited on the charging roller 3. For this purpose, an amount of electric charge applied to the transfer residual toner by the second electroconductive brush 6*b* may preferably be about two times that of the toner during the development and is about −50 μC/g in the environment of the temperature of 23° C. and the absolute water content of 10.5 g/cm$^3$.

The auxiliary charging apparatus 6 is provided with a reciprocating mechanism (not shown) which is driven together with the drum 2. By this reciprocating mechanism, the first and second electroconductive brushes 6*a* and 6*b* are reciprocated in a main scanning direction (drum generating line direction) to efficiently collect the transfer residual toner on the drum 2 and polishing particles described later.

Next, the collection of the transfer residual toner in the developing step will be described. As described above, the developing apparatus 4 collects the transfer residual toner simultaneously with the development to clean the drum surface. A toner charge amount (average value) used for developing the electrostatic latent image on the drum 2 is about −25 μC/g in the environment of the temperature of 23° C. and the absolute water content of 10.5 g/m$^3$. In order to ensure sufficient collection of the transfer residual toner on the drum 2 in the developing apparatus 4, it is preferable that the transfer residual toner reaching the developing apparatus 4 has a charge amount in a range of 15-35 μC/g. However, as described above, in order to collect in the developing apparatus 4 the transfer residual toner which has been negatively charged to have the charge amount of −50 μC/g by the second electroconductive brush 6*b* so as to prevent the deposition of the transfer residual toner on the charging roller 3, it is necessary to perform electric charge removal. To the charging roller 3, the AC voltage (frequency=1.3 kHz, peak-to-peak voltage Vpp=1.5 kV) has been applied for electrically charging the drum 2. At that time, the charging roller 3 electrically charges the drum surface and at the same time, the transfer residual toner on the drum 2 is charge-removed by the AC voltage application. The negatively large charge amount (−50 μC/g) of the transfer residual toner under the AC voltage application condition is decreased to about −30 μC/g in terms of an absolute value after the transfer residual toner passes through the charging portion. As a result, in the developing step, the transfer residual toner which is the toner deposited at a portion (non-image portion) where the toner should not be deposited is collected in the developing apparatus 4.

In the above-described manner, the charge amount of the transfer residual toner conveyed from the transfer portion to the charging portion by the rotation of the drum 2 is made uniform to the negative polarity as the normal toner charge polarity by electrically charging the transfer residual toner with the second electroconductive brush 6*b*, so that the deposition of the transfer residual toner on the charging roller 3 is prevented. The surface of the drum 2 is electrically charged to a predetermined potential by the charging roller 3, and at the same time, the charge amount of the transfer residual toner electrically charged negatively to have the normal toner charge polarity by the second electroconductive brush is controlled by the developing apparatus 4 so as to be the same level as that during the development on the drum 2.

As a result, the collection of the transfer residual toner by the developing apparatus 4 is performed efficiently. According to the above-described cleanerless system, particularly the simultaneous developing and cleaning method, it is not necessary to particularly provide the cleaning apparatus as described above and the transfer residual toner can be used again without producing waste toner, so that the system or method not only largely contributes to elimination of inconvenience of maintenance and downsizing of the image forming apparatus but also is preferable in terms of environmental protection and effective use of resources.

(3) Control of Polishing Particles and Amount of Polishing Particles Contained in Auxiliary Charging Means In this embodiment, polishing particles having a property of being electrically charged to an opposite polarity to the normal toner charge polarity are contained in the developer in the developing container 4*a* and in the supply toner in the toner hopper 4*d*.

In this embodiment, the polishing particles comprise strontium titanate having a positive triboelectric chargeability (positive charge polarity) More specifically, the polishing particles of strontium titanate have an average primary particle size of 30 nm or more and 300 nm or less, a cubic or rectangular parallelepiped particle shape, and perovskite crystal. In the case of using such polishing particles of strontium titanate, it is possible to effectively remove an electric discharge product even in an image forming apparatus provided with no member for strongly rubbing the drum 2 such as a cleaner blade. In this embodiment, the polishing particles are added in the amount of 0.2 wt. % in the toner.

As described above, by electrically charging the polishing particles to an opposite polarity to the charge polarity of the toner, an amount of the polishing particles transferred onto the belt 16 can be reduced as small as possible, so that it is possible to stably supply the polishing particles to the auxiliary charging apparatus 6.

The polishing particles are isolated in the developer and supplied from the developing sleeve 4*b* to the drum 2 when a fog-removing bias (Vback potential) is generated principally between the developing sleeve 4*b* and the drum 2. The Vback potential is a contrast between a developing bias and a potential on the drum 2 after the electric charging and before the transfer.

The polishing particles are contained in the first and second electroconductive brushes 6*a* and 6*b* of the auxiliary charging apparatus 6 after passing through the transfer portion. In this embodiment, the polishing particles having the positive charge polarity are used, so that the polishing particles are accumulated in a large amount on the second electroconductive brush 6*b* to which a negative-polarity bias is applied. In this embodiment, the above-described fog-removing bias (Vback potential) is 150 V.

Here, a problem occurring in the image forming apparatus employing the above-described constitution will be described. In this embodiment, in the case where image formation is successively performed many times at a low print ratio (i.e., an image duty of 2% or less), the polishing particles are supplied in a large amount to the auxiliary charging apparatus 6. This is because there is a larger area (dark-part potential area) in which image exposure is not performed, so that the polishing particles are contained in the area. As a result, the polishing particles cannot be completely collected in the auxiliary charging apparatus 6, so that the polishing particles are deposited on the charging roller 3 in a large amount, thus causing an occurrence of image failure due to charging non-uniformity.

Further, in the case where image formation is successively performed many times at a high print ratio (e.g., an image duty of 30% or more), the transfer residual toner is generated in a large amount. When the transfer residual toner passes through the auxiliary charging apparatus 6, the polishing particles contained in the first and second electroconductive brushes 6*a* and 6*b* of the auxiliary charging apparatus 6 are deposited or attached to the toner, so that the polishing particles are discharged together with the toner. As a result, the polishing particles contained in the first and second electroconductive brushes 6*a* and 6*b* are depleted to cause an occurrence of image flow.

First, a polishing particles supplying method and a polishing particle removing method will be described.

(Polishing Particle Supplying Method)

Figure 7:
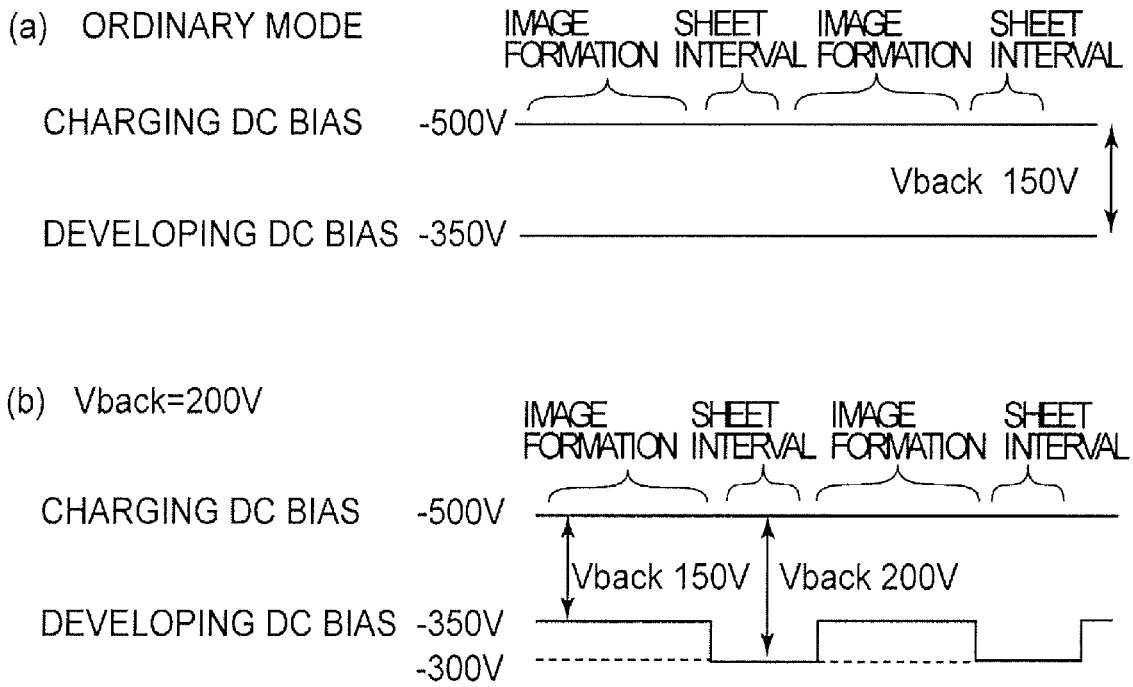
FIGS. 7(*a*) and 7(*b*) are schematic views for illustrating an operation for supplying the polishing particles to the auxiliary charging apparatus in Embodiments 1 and 2.
Figure 8:
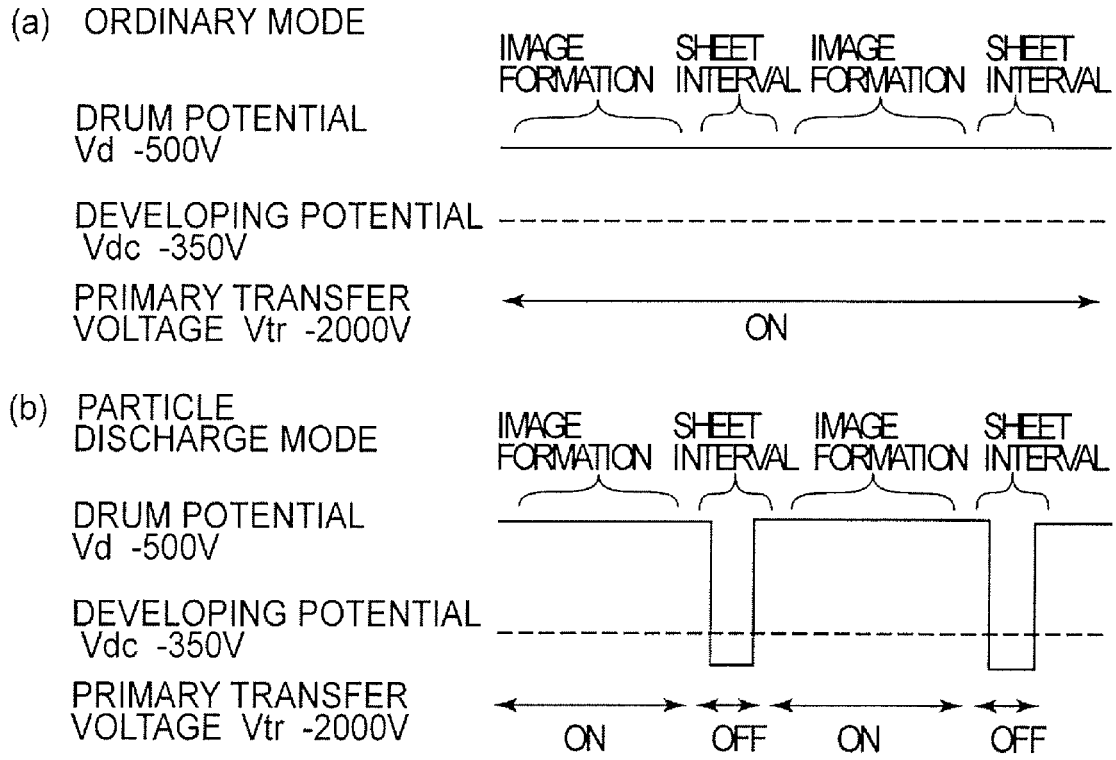
FIGS. 8(*a*) and 8(*b*) are schematic views for illustrating an operation for removing the polishing particles from the auxiliary charging apparatus.

As shown in FIG. 7(*b*), during non-image formation (sheet interval) in a successive copying operation, the fog-removing potential (Vback) is increased from 150 V to 200 V, so that supply of the polishing particles from the developing apparatus 4 to the drum 2 is accelerated. In other words, supply of the polishing particles to the auxiliary charging apparatus 6 is accelerated. At the sheet interval corresponding to a non-image forming portion in this case, a charging condition for a charging DC bias during image formation (FIG. 7(*b*)) is identical to that during image formation in an ordinary mode (FIG. 7(*a*)), so that a surface potential is a dark-part potential at which light exposure is not performed.

Control of the amount of the polishing particles contained in the auxiliary charging means is effected by changing a voltage applied to the auxiliary charging means between in the ordinary mode (FIG. 7(*a*)) and in a control mode of the polishing particle amount (FIG. 7(*b*)). Further, between in the ordinary mode and in the polishing particles amount control mode, at least one of voltages applied to the charging means and the developing means is changed.

In order to remove the polishing particles excessively from the auxiliary charging apparatus 6, an ON/OFF operation of application of the voltage to the auxiliary charging apparatus 6 is repeated at the non-image forming portion (sheet interval) during the successive copying operation. As a result, a potential difference is created between the auxiliary charging apparatus 6 and the drum 2 to effect discharging of the polishing particles, so that the discharged polishing particles are collected in the developing apparatus.

More specifically, at the non-image forming portion (sheet interval) during the successive copying operation, a toner image having predetermined lengths in a main scanning direction and a subscanning direction with respect to the developing apparatus 4 (a solid black streak image of a size of 290 mm×15 mm in this embodiment) is formed on the photosensitive member. The thus formed toner image is caused to pass through the auxiliary charging apparatus 6 without being transferred onto the belt 16 to deposit (attach) the polishing particles onto the toner, so that the polishing particles are collected together with the toner in the developing apparatus.

In this embodiment, as a means for controlling the amount of the polishing particles contained in the auxiliary charging means, a predetermined toner image is formed on the image bearing member at a timing of non-image formation and caused to pass through the auxiliary charging means without being transferred onto the recording medium. At this time, the charging condition may be identical to the image forming condition.

In this embodiment, as a means for controlling the amount of the polishing particles contained in the auxiliary charging means, a predetermined toner image is formed on the image bearing member at a timing other than image formation and caused to pass through the auxiliary charging means without being transferred onto the recording medium.

As another method, it is also possible to discharge the polishing particles by applying a bias of identical polarity to the charge polarity of the polishing particles to the auxiliary charging means. At that time, in order to prevent the polishing particles from being deposited on the charging roller, it is necessary to turn off at least the application of the DC voltage as the charging condition.

(Executing Method)

Next, an executing method of executing the polishing particle supply and the polishing particle removal will be described.

The image forming apparatus according to this embodiment employs a video count method using a video count (number) of an image density of an image information signal as an image ratio read by a CCD or the like. More specifically, a level of an output signal from an image signal processing circuit 202 (FIG. 1) is counted for each pixel and the count (number) is integrated with respect to the number of pixels for a unit paper (sheet) size (A4 size in this embodiment), so that a video count T per (one sheet of) original is obtained. More specifically, a video count value of an image density is integrated by a storing means and from which an average image duty is obtained. For example, with respect to one A4-size sheet, a maximum video count is 3884×384 at 400 dpi and 256 gradation levels.

From integration of this video count and the number of copied sheets, an average image duty J per (one) job is calculated.

Figure 6:
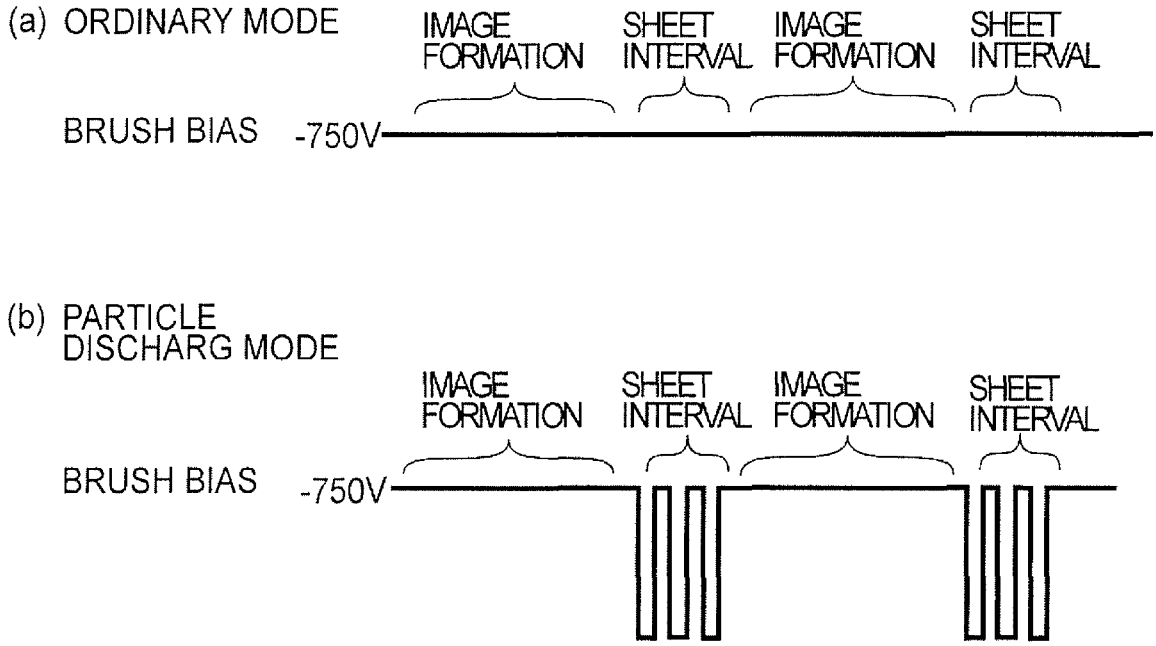
FIGS. 6(*a*) and 6(*b*) are schematic views for illustrating an operation for removing polishing particles from an auxiliary charging apparatus in Embodiment 1.
Figure 9:
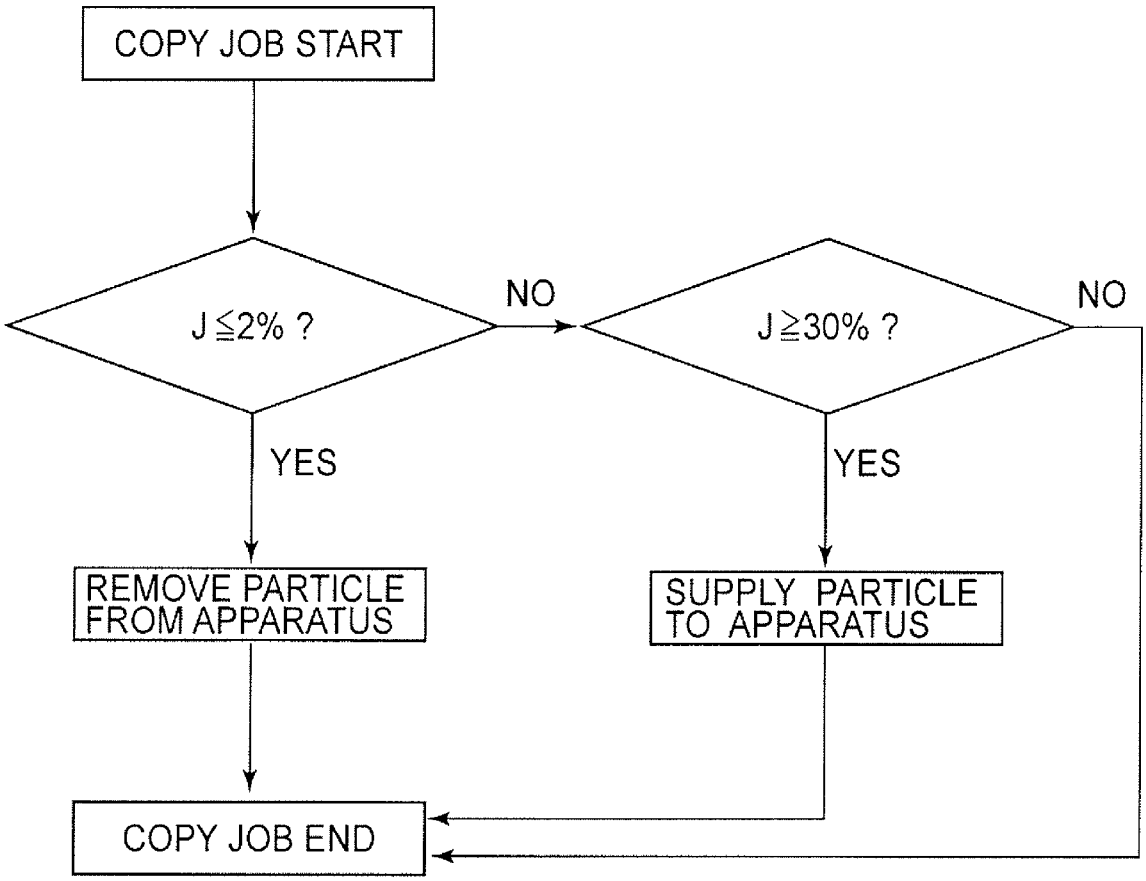
FIG. 9 is a flowchart for determining sheet interval setting during a copying operation.

In FIG. 9, the control circuit portion 200 judges that the polishing particles in the developing apparatus are supplied in a large amount to the auxiliary charging apparatus 6 when the average image study J per job is a predetermined threshold value (2% in this embodiment) or less. In this embodiment, the control circuit portion 200 is a determination means for determining whether or not which of a polishing particle supplying mode and a polishing particle discharging mode is executed. In order to prevent the polishing particles from being excessively contained in the auxiliary charging apparatus 6, as shown in FIG. 6(*b*), repetitive ON/OFF control of application of a voltage to the second electroconductive brush 6*b* is effected at the non-image forming portion (sheet interval) during the copying job. By this control, a potential difference is created between the second electroconductive brush 6*b* and the drum 2, so that discharge of the polishing particles from the second electroconductive brush 6*b* to the drum 2 is accelerated. The thus discharged polishing particles are collected in the developing apparatus by rubbing with ears of the magnetic brush of the developing sleeve 4*b*.

Further, when the average image duty J per job is equal to or more than a predetermined threshold value (30% or more in this embodiment), the control circuit portion 200 judges that the amount of the polishing particles contained in the auxiliary charging apparatus 6 is insufficient. In this case, as shown in FIG. 7(*b*), the fog-removing potential (Vback) is increased from 150 V to 200 V at the non-image forming portion (sheet interval) during the copying job, so that supply of the polishing particles from the developing apparatus 4 to the drum 2 is accelerated. That is, supply of the polishing particles to the auxiliary charging apparatus 6 is accelerated.

In the case where the average image duty J does not satisfy the above-described two conditions (threshold values), both of the supply and removal of the polishing particles are not performed.

As described above, on the basis of the image ratio, the amount of the polishing particles contained in the auxiliary charging apparatus 6 is judged, so that it is possible to always contain a stable amount of the polishing particles in the auxiliary charging apparatus 6. As a result, it is possible to provide an image forming apparatus which does not cause the occurrence of image failure such as streak image or image flow.

In this embodiment, by obtaining the average image duty per job, the supply or removal of the polishing particles is determined but another method may also be employed. For example, the video count value is integrated by the storing means until it reaches a predetermined sheet number. Then, in the case where the video count value integrated until it reaches the predetermined sheet number reaches a predetermined value as a threshold value, judgment that an image having a high image ratio is formed in a large amount is made. For this reason, on the basis of the video count value, the polishing particles supplying mode is performed. Further, it is also possible to achieve a similar effect by a method of executing the polishing particles discharging mode when the video count value is less than the predetermined value.

In this embodiment, the supplying/removing operation of the polishing particles with respect to the auxiliary charging apparatus 6 is performed at the sheet interval but the present invention is not limited thereto. The supplying/removing operation of the polishing particles may also be performed at the time of pre-rotation during copying job start or at the time of post-rotation after completion of the copying job or at the time when the image forming operation is once stopped during the copying job.

In this embodiment, the polishing particles supplying mode, the polishing particles discharging (removing) mode, and a standby mode are selectable. In addition, in such a case where the standby mode is successively continued, it is also possible to employ a constitution in which the polishing particles contained in the auxiliary charging member are refreshed by performing the polishing particles discharging mode and then performing the polishing particles supplying mode.

Further, in this embodiment, the judgment as to whether or not the polishing particles supplying/removing operation is performed every predetermined number of copied sheets is mode. However, the present invention is not limited thereto. For example, the polishing particles supplying/removing operation may also be performed as desired after the amount of the polishing particles contained in the auxiliary charging apparatus 6 is judged from an integration result of an amount of toner supply every completion of each copying job.

Figure 14:
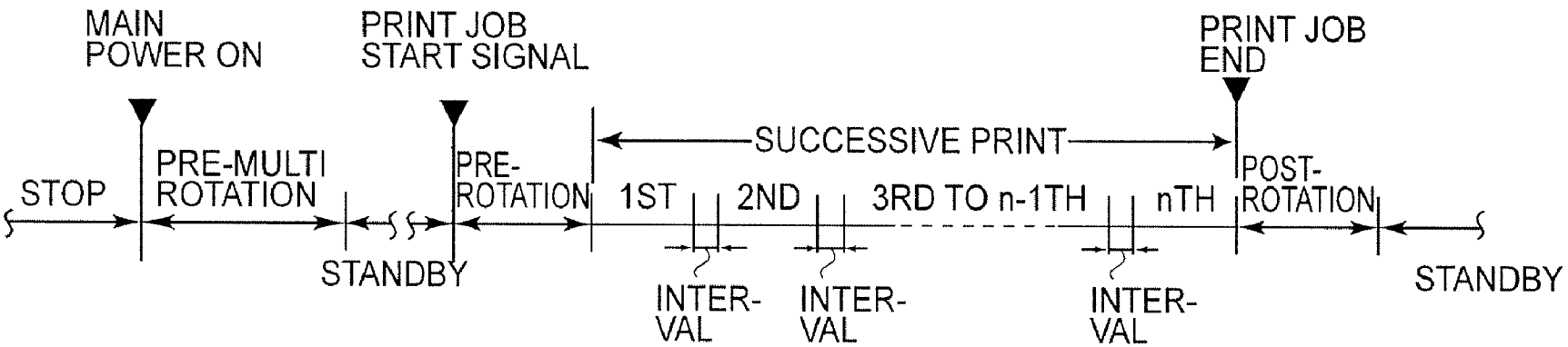
FIG. 14 is an operation diagram of an image forming apparatus.

FIG. 14 shows an operation step diagram of the above-described image forming apparatus.

This step is performed in a predetermined start (actuation) operation period (warm-up period) of the image forming apparatus. In this step, a main power switch of the image forming apparatus is turned on to actuate a main motor of the image forming apparatus so as to perform a preparation operation of necessary process equipment.

b: Standby

After the predetermined start operation period is ended, the drive of the main motor is stopped and the image forming apparatus is kept in a standby state until a print job start signal is inputted.

c: Pre-Rotation Step

In a period for a pre-rotation step, the main motor is driven again on the basis of the input of the print job start signal to perform a print job pre-operation of necessary process equipment.

In an actual operation, (1) the image forming apparatus receives the print job start signal, (2) an image is decompressed by a formatter (a decompression time varies depending on an amount of image data or a processing speed of the formatter, and then (3) the pre-rotation step is started.

Incidentally, in the case where the print job start signal is inputted during the pre-multirotation step (a), after the pre-multirotation step (a) is completed, the operation goes to this pre-rotation step (c) with no standby (b).

d: Print Job Execution

Immediately after the predetermined pre-rotation step is completed, the above-described image forming process is executed, so that a recording material on which the image has been formed is outputted. In the case of a successive print job, the image forming process is repeated, a predetermined number of sheets of the image-formed recording material are outputted.

e: Sheet Interval Step

This step is a step of an interval between a trailing end of a recording material P and a leading end of a subsequent recording material P in the case of the successive print job. A period for this step corresponds to a non-sheet passing state period at the transfer portion or in the fixing apparatus.

f: Post-Rotation Step

In a predetermined period for a post-rotation step, the main motor is continuously driven for a predetermined time even after the image-formed recording material is outputted in the case of the print job for one sheet or after a final image-formed recording material is outputted in the case of the successive print job. In this period, a print job post-operation of necessary process equipment is performed.

g: Standby

After the predetermined post-rotation step is completed, the drive of the main motor is stopped and the image forming apparatus is kept in a standby state until a subsequent print job start signal is inputted.

In the above-described operation, the period for the print job execution (d) is an image forming period, and the periods for the pre-multirotation step (a), the pre-rotation step (c), the sheet interval step (e), and the post-rotation step (f) are a non-image forming period.

Herein, the non-image forming period means at least one of the periods for the above-described steps (a), (c), (e) and (f) or at least a predetermined (period of) time in the periods for these steps.

Embodiment 2

In Embodiment 2, an image forming process is substantially identical to that in Embodiment 1, so that a redundant description will be omitted as appropriate. In Embodiment 1, the image ratio is obtained on the basis of the video count but in this embodiment, the image ratio is calculated from an amount of toner supply.

Figure 5:
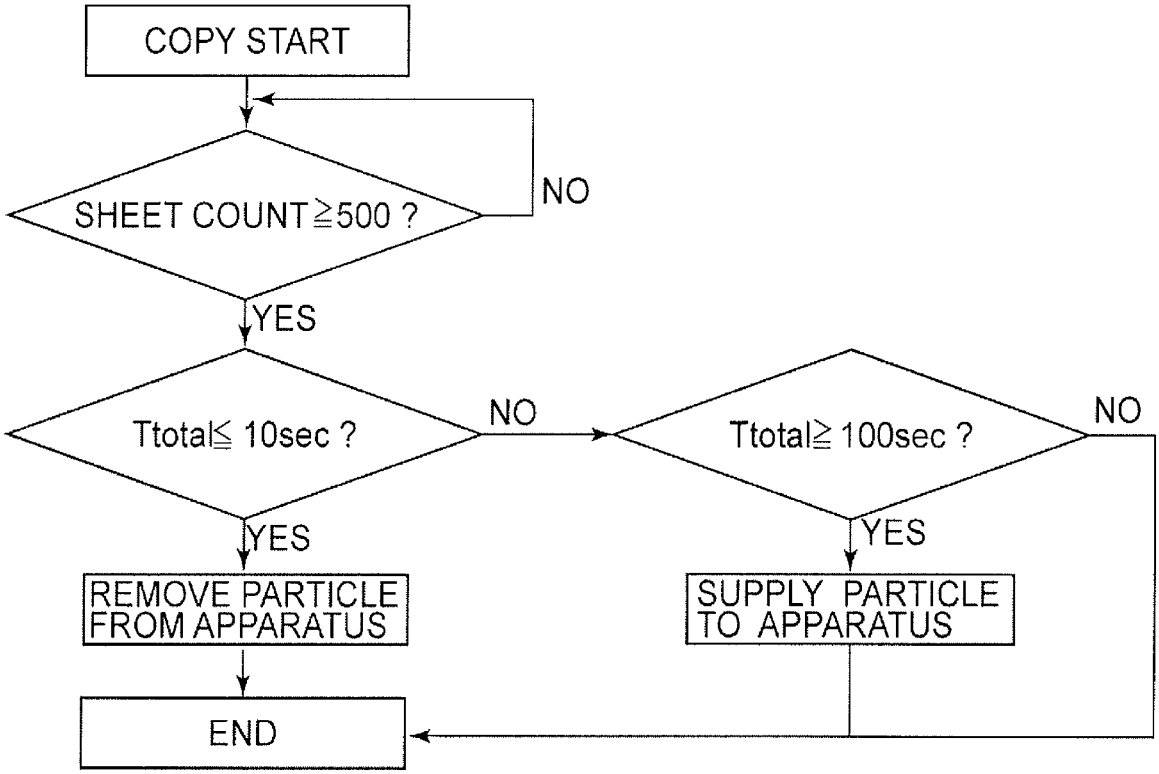
FIG. 5 is a flowchart for determining sheet interval setting during a copying operation in Embodiments 1 and 2.

Referring to FIG. 5, the control circuit portion 200 judges an amount of polishing particles contained in the auxiliary charging apparatus 6 in accordance with two cases 1) or 2) shown below when the copy number of sheets (sheet count by integration) after start of copying reaches a predetermined number (every 500 sheets in this embodiment).

1) Case where an integration value Ttotal, of a supplying screw rotation time for 500 sheets stored in RAM as the storing means is 10 sec (supply toner amount=4.0 g) or less. In this case, it is judged that the polishing particles in the developing apparatus are supplied to the auxiliary charging apparatus 6 in a large amount. For this reason, in this case, the polishing particle particles discharge mode is performed.

As described above, in this embodiment, the amount of the polishing particles contained in the auxiliary charging apparatus 6 is judged on the basis of an integration result of the amount of toner supply for each predetermined copy number of sheets, so that it is possible to always contain the polishing particles in the auxiliary charging apparatus 6 in a stable amount. As a result, it is possible to provide an image forming apparatus which does not cause the occurrence of image failure such as streak image or image flow.

In this embodiment, the supplying/removing operation of the polishing particles is performed at the sheet interval in the non-image forming period but the present invention is not limited thereto. The supplying/removing operation of the polishing particles may also be performed in the period for the pre-rotation during copying job start or in the period for the post-rotation after completion of the copying job or in the period in which the image forming operation is once stopped during the copying job.

In this embodiment, the polishing particles supplying mode, the polishing particles discharging (removing) mode, and a standby mode are selectable. In addition, in such a case where the standby mode is successively continued, it is also possible to employ a constitution in which the polishing particles contained in the auxiliary charging member are refreshed by performing the polishing particles discharging mode and then performing the polishing particles supplying mode.

Embodiment 3

In Embodiment 3, an image forming process is substantially identical to those in Embodiment 1 and Embodiment 2, so that a redundant description will be omitted as appropriate.

In this embodiment (Embodiment 3), in addition to the polishing particles supplying operation to the auxiliary charging apparatus 6 and the polishing particles removing operation from the auxiliary charging apparatus 6 as described in Embodiment 1 and Embodiment 2, an operation for removing toner from the auxiliary charging apparatus 6 is performed in the case where a particular condition is satisfied.

More specifically, in the case where formation of an image having a high print ratio is successively performed, a large amount of toner is contained in the auxiliary charging apparatus 6 to increase a brush resistance of the auxiliary charging apparatus 6. As a result, with respect to the auxiliary charging apparatus 6, an electrically charging performance for the transfer residual toner is lowered, so that a toner collecting performance is lowered, thus resulting in an occurrence of contamination of the charging apparatus and the photosensitive drum in some cases.

In this embodiment, in the case where the formation of the high print ratio image is successively performed, the operation for removing the toner contained in the auxiliary charging apparatus 6 is performed.

Figure 10:
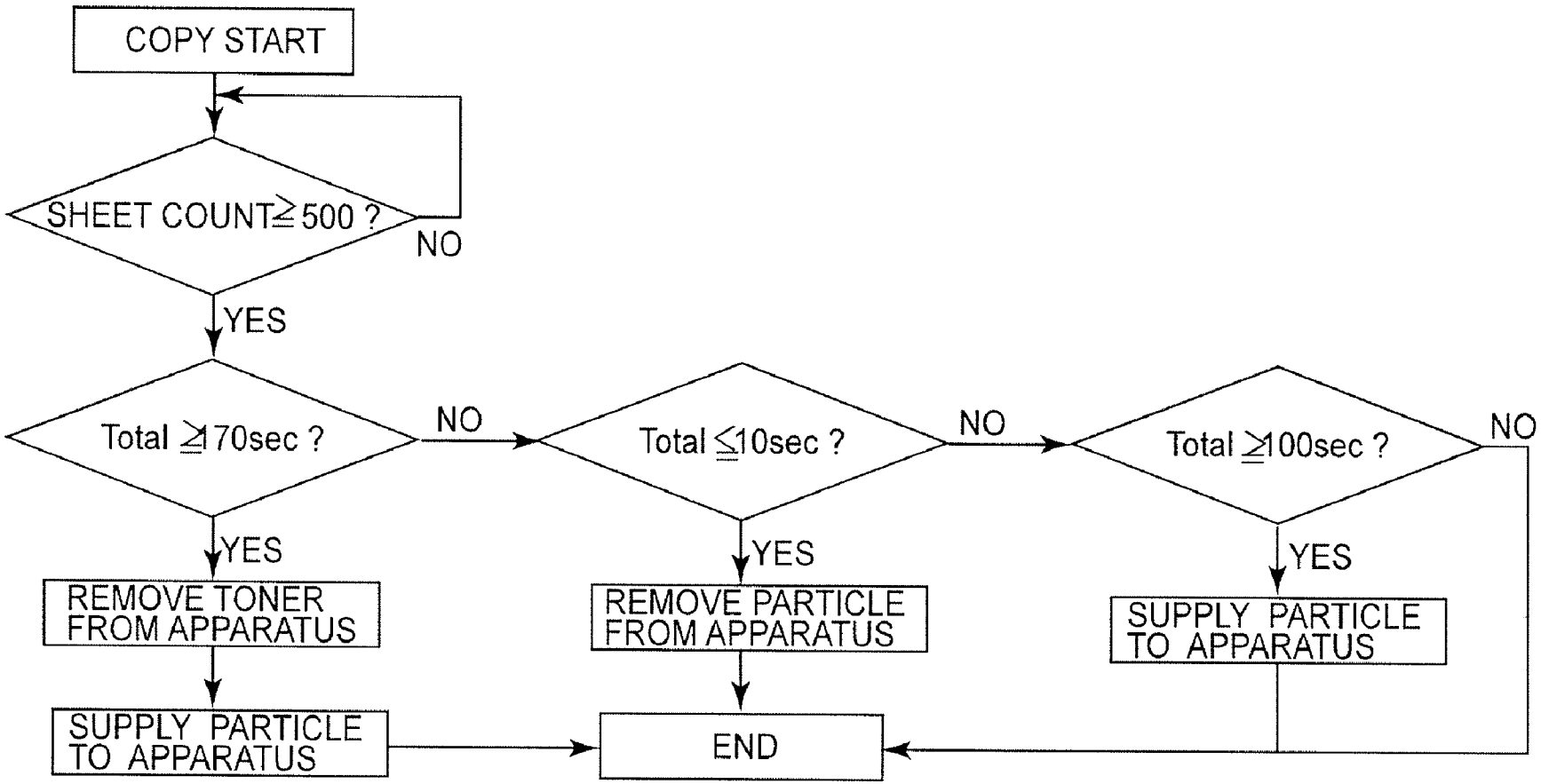
FIG. 10 is a flowchart for determining sheet interval setting during a copying operation in Embodiment 3.

Referring to FIG. 10, the control circuit portion 200 judges an amount of polishing particles contained in the auxiliary charging apparatus 6 in accordance with three cases 1), 2) or 3) shown below when the copy number of sheets (sheet count by integration) after start of copying reaches a predetermined number (every 500 sheets in this embodiment).

1) In the case where an integration value Ttotal, of a supplying screw rotation time for 500 sheets stored in the storing portion 201 is 170 sec (supply toner amount=68.0 g) or more, it is judged that the toner is contained in the auxiliary charging apparatus 6 in a large amount.

Figure 11:
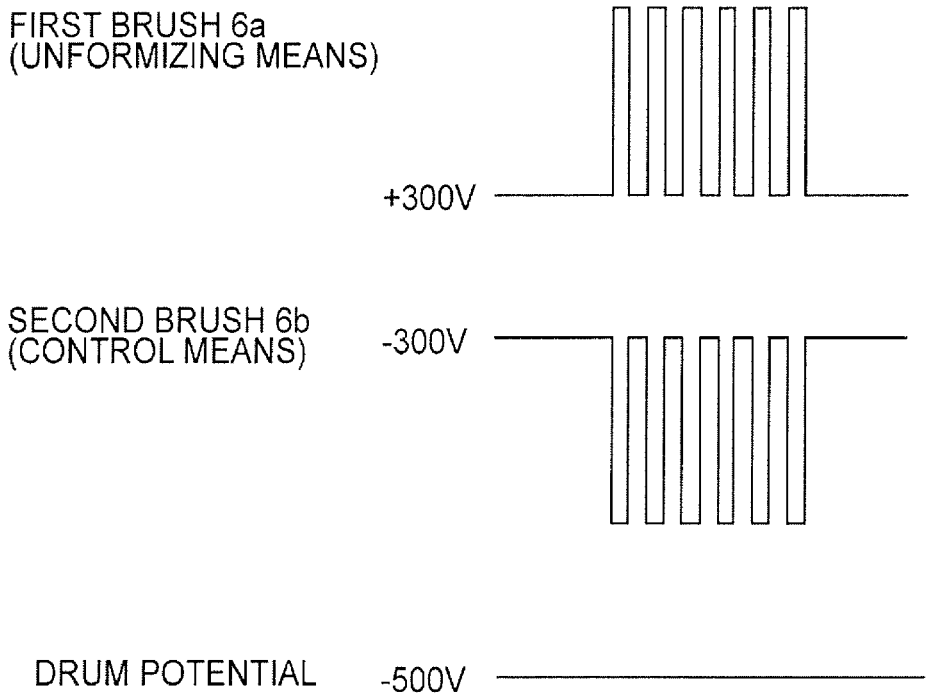
FIG. 11 is a schematic view for illustrating an operation for removing toner from the auxiliary charging apparatus in Embodiment 3.

In order to remove the toner excessively contained in the auxiliary charging apparatus 6, the image forming operation is once terminated and repetitive ON/OFF control of voltage application to the first and second electroconductive brushes 6*a* and 6*b* of the auxiliary charging apparatus 6 as shown in FIG. 11. As a result, a potential difference is created between the drum 2 and the first and second electroconductive brushes 6*a* and 6*b* to accelerate discharge of the toner from the first and second electroconductive brushes 6*a* and 6*b* to the drum 2. The thus discharged toner is collected in the developing apparatus 4 by the developing sleeve 4*b*.

Then, in order to supply the polishing particles to the auxiliary charging apparatus 6 in a required amount, as shown in FIG. 7(*b*), the fog-removing potential (Vback) is increased from 150 V to 200 V at the non-image forming portion (sheet interval) during the successive copying operation. As a result, the supply of the polishing particles from the developing apparatus 4 to the drum 2 is accelerated. That is, the supply of the polishing particles to the auxiliary charging apparatus 6 is accelerated.

2) In the case where the integration value Ttotal of the supplying screw rotation time for 500 sheets is 10 sec (supply toner amount=4.0) or less, it is judged that the polishing particles in the developing apparatus 4 is supplied to the auxiliary charging apparatus 6 in a large amount.

In order to remove the polishing particles excessively contained in the auxiliary charging apparatus 6, repetitive ON/OFF control of voltage application to the second electroconductive brush 6*b* at the non-image forming portion (sheet interval) during the successive copying operation as shown in FIG. 6(*b*). As a result, a potential difference is created between the drum 2 and the second electroconductive brush 6*b* to accelerate discharge of the polishing particles. The thus discharged polishing particles are collected in the developing apparatus 4 by rubbing with ears of the magnetite brush of the developing sleeve 4*b*.

3) In the case where the integration value Ttotal, of the supplying screw rotation time for 500 sheets, stored in the storing portion 201 when the copy number of sheets reaches 500 (sheets) is 100 sec (supply toner amount=40.0 g) or more, it is judged that the amount of the polishing particles contained in the auxiliary charging apparatus 6 is insufficient.

Then, as shown in FIG. 7(*b*), the fog-removing potential (Vback) is increased from 150 V to 200 V at the non-image forming portion (sheet interval) during the successive copying operation, so that the supply of the polishing particles from the developing apparatus 4 to the drum 2 is accelerated. That is, the supply of the polishing particles to the auxiliary charging apparatus 6 is accelerated.

As described above, in this embodiment, the amounts of toner and polishing particles contained in the auxiliary charging apparatus 6 are judged on the basis of an integration result of the amount of toner supply for each predetermined copy number of sheets, so that it is possible to always contain the polishing particles in the auxiliary charging apparatus 6 in a stable amount while a lowering in function of the auxiliary charging apparatus 6 due to the toner deposition is prevented. As a result, it is possible to provide an image forming apparatus which does not cause the occurrence of image failure such as streak image or image flow. In this embodiment, the polishing particles amount is judged on the basis of the integration result of the amount of supply toner but a similar effect can also be achieved by employing a constitution using an image ratio when the copy number of sheets (sheet count by integration) after the start of the copying operation.

Embodiment 4

In Embodiment 4, an image forming process is substantially identical to those in Embodiments 1 to 3 described above, so that a redundant description will be omitted.

In this embodiment, when image formation on small-size paper is performed, a fog-removing potential at a non-image forming portion is made smaller than that at an image portion with respect to a main scanning direction, so that an amount of supply of polishing particles at an end portion is reduced.

When an area width of an image formed on an image bearing member in the main scanning direction is smaller than a maximum image area width, a potential difference between the image bearing member and the developing apparatus in an image area is different from that in a non-image area.

More specifically, in the case where a successive copying (printing) operation on the small-size paper is performed many times, the fog-removing potential (Vback) is always applied at an end position in the main scanning direction, so that the toner is not consumed but the polishing particles are supplied in a large amount. As a result, the polishing particles cannot be completely collected at an end portion of the auxiliary charging apparatus 6, so that end portions of the charging roller 3 and the drum 2 are contaminated with the polishing particles. In this state, when image formation on ordinary-size paper is performed, image failure such as streak image due to charging failure is caused to occur at an image end portion.

Figure 12:
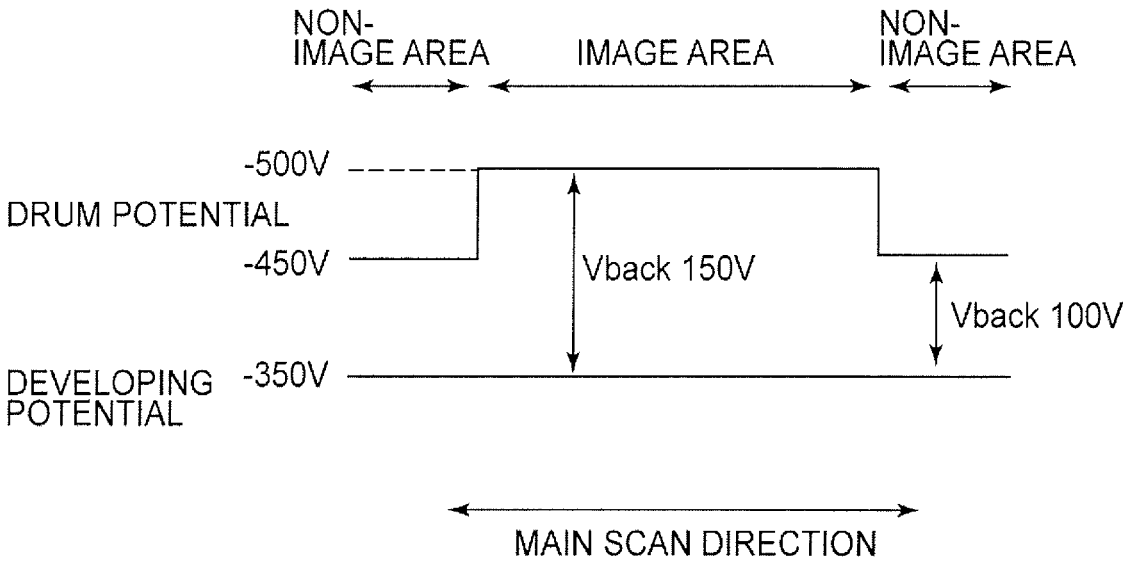
FIG. 12 is a schematic view for illustrating setting of a fog-removing voltage during image formation on small-size paper in Embodiment 4.

In this embodiment, as shown in FIG. 12, with respect to the main scanning direction, the fog-removing potential is 150 V in the image area and 100 V in the non-image area (both end portions). In the non-image area, the developing potential is identical to that (−350 V in this embodiment) in the image area and the drum potential is set to −500 V by electrically charging the drum 2 in an entire area with respect to the main scanning direction and is changed to −450 V by the exposure apparatus 7. In the image area after the exposure, an electric potential varies depending on an image to be formed.

Incidentally, when a recording material having a width smaller than a maximum passing width of the recording material in a direction perpendicular to a conveyance direction of the recording material is conveyed, the control circuit portion 200 functions as a control means capable of effecting potential control so that a potential contrast between the developing bias and the charging potential before the exposure in the non-image area is smaller than that in the image area.

As described above, when the image formation on the small-size paper is effected, the fog-removing potential at the non-image portion is smaller than that at the image portion with respect to the main scanning direction, so that the supply amount of the polishing particles at the end portion is reduced. For this reason, even when a large number of sheets of the small-size paper are subjected to the copying operation, it is possible to always contain the polishing particles in the auxiliary charging member in a stable amount. As a result, it is possible to provide an image forming apparatus which does not cause an occurrence of image failure such as streak image and image flow.

Embodiment 5

In Embodiment 5, an image forming process is substantially identical to those in Embodiments 1 to 3 described above, so that a redundant description will be omitted.

In this embodiment, when image formation on small-size paper is successively performed, the polishing particles contained at an end portion of the auxiliary charging apparatus 6 is removed every predetermined copy number of sheets.

In the case where an image having an area width smaller than a maximum image area width with respect to the main scanning direction is formed successively on the image bearing member by a predetermined copy number of sheets of the small-size paper, the following control is effected. More specifically, at a timing other than the image forming period, a predetermined toner image is formed on the image bearing member in the non-image area with respect to the main scanning direction, so that the toner image is caused to pass through the auxiliary charging means without being transferred onto the recording medium.

Figure 13:
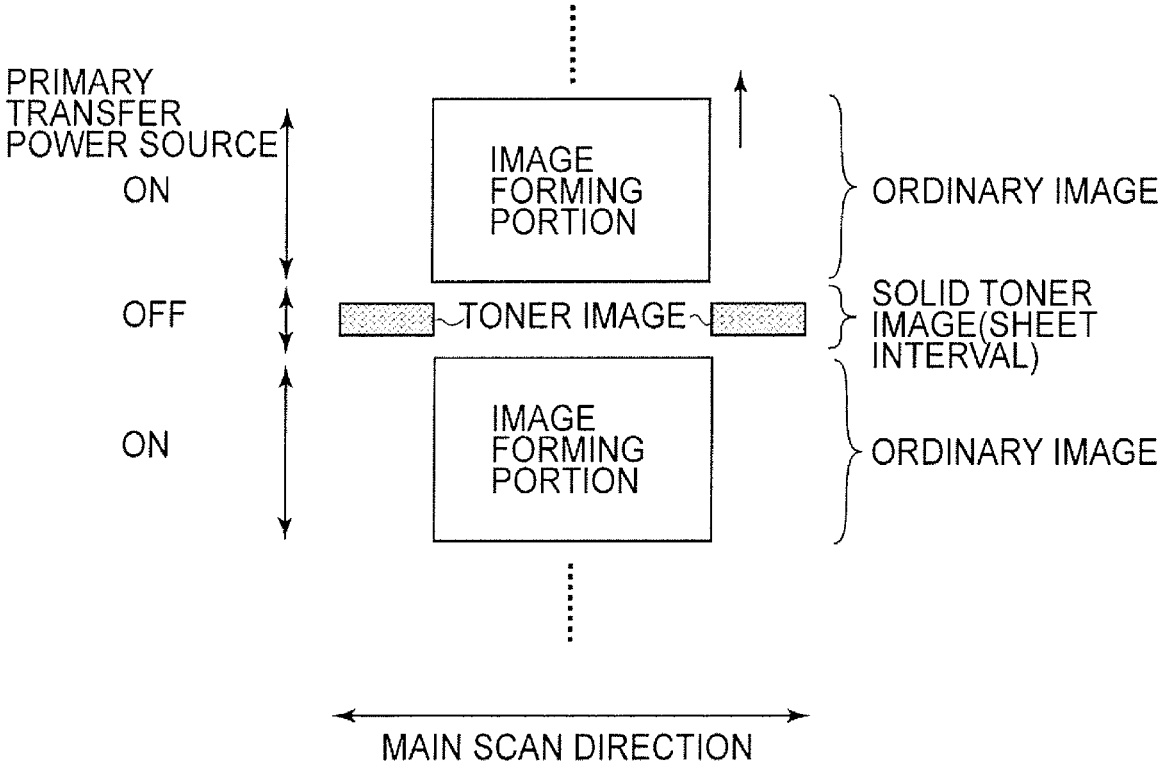
FIG. 13 is a schematic view for illustrating an operation for removing the polishing particles from a non-image area at an end portion during image formation on small-size paper with respect to the auxiliary charging apparatus in Embodiment 5.

In this embodiment, in the case where the small-size paper is successively subjected to a copying operation by the predetermined copy number of sheets (100 sheets in this embodiment), control as shown in FIG. 13 is effected in order to remove the polishing particles excessively contained at an end portion of the auxiliary charging apparatus 6. More specifically, at a non-image forming portion (sheet interval) during the successive copying operation, a toner image (a solid image having a length of 15 mm in the subscanning direction in this embodiment) is formed on the drum 2 at the non-image forming portion at an end portion with respect to the main scanning direction. The thus formed toner image is caused to reach and pass through the auxiliary charging apparatus 6 without being transferred onto the belt by turning off the application of the transfer bias to the primary transfer roller 5. As a result, the polishing particles contained at the end portion of the auxiliary charging apparatus 6 are attached to the toner, thus being collected in the developing apparatus 4 together with the toner.

As described above, when the image formation on the small-size paper is successively effected by the predetermined copy number of sheets, discharge of the polishing particles by the toner image is performed at a portion other than an image size with portion, so that the polishing particles excessively accumulated at the end portion of the auxiliary charging apparatus 6 can be removed. For this reason, it is possible to always contain the polishing particles in the auxiliary charging apparatus 6 in a stable amount. As a result, it is possible to provide an image forming apparatus which does not cause an occurrence of image failure such as streak image and image flow.

In this embodiment, the supplying/removing operation of the polishing particles is performed at the sheet interval but the present invention is not limited thereto. The supplying/removing operation of the polishing particles may also be performed in the period for the pre-rotation during copying job start or in the period for the post-rotation after completion of the copying job or in the period in which the image forming operation is once stopped during the copying job.

Other Embodiments

1) In the above-described embodiments, the polishing particle discharging mode and the polishing particle supplying mode are executed in one job but may also be executed at the time when it is judged that the total copy number of sheets reaches a predetermined number.

2) The exposure means 7 as the information writing means is not limited to the laser beam scanner in embodiments described above but may also be another digital exposure apparatus such as a combination of a light source such as an LED array or a fluorescent lamp with a liquid crystal shutter or the like or an analog exposure apparatus for forming or projecting an original image.

3) The image bearing member 2 may also be an electrostatic recording dielectric member. In this case, the surface thereof is electrically charged uniformly to a predetermined polarity and a predetermined potential and then is charge-removed selectively by a charge-removing means (information writing means) such as an array of electric discharging needless or an electron gun, so that an electrostatic latent image corresponding to image information is written or formed on the image bearing member surface. The shape of the image bearing member 2 is not limited to the drum but may also be a rotation belt (endless belt), a non-endless sheet attached to and held by a rotation belt-like support.

4) The toner developing method and means with respect to the electrostatic latent image may appropriately be selected from, e.g., the reverse developing method, a normal developing method, and those using a monocomponent developer.

5) The transfer means 5 and 15 are not limited to the transfer roller used in Embodiments described above but may also be a transfer blade, a transfer belt, other means using the contact transfer charging method, and a corona charger using a non-contact transfer charging method.

6) The image forming apparatus may also be a direct transfer-type image forming apparatus in which a toner image on an image bearing member is directly transferred onto a recording material P as a secondary transfer medium without using the intermediary transfer member.

7) As a waveform of the A1 voltage for the bias applied to the contact charging member 3 or the developing apparatus 4, it is possible to appropriately use a sinusoidal waveform, a rectangular waveform, a triangular waveform, etc. The AC bias may also include, e.g., a voltage of a rectangular wave waveform produced by periodically turning on and off a DC power source.

As described hereinabove, according to the present invention, the amount of polishing particles can be stabilized even when excessive supply or insufficient supply of the polishing particles to the auxiliary charging means occurs depending on an image forming condition.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 161001/2006 filed Jun. 9, 2006, which is hereby incorporated by reference.

What is claimed is:

1. An image forming apparatus comprising:

a rotatable photosensitive member;

a charging device for charging said photosensitive member;

an exposure device for exposing said photosensitive member charged by said charging device with light to form an electrostatic image;

a developing device for developing, into a toner image, the electrostatic image formed by said exposure device on said photosensitive member with a developer including toner and polishing particles, wherein the polishing particles have a polarity opposite a regular charging polarity of the toner;

a transferring device for transferring the toner image, developed by said developing device, from said photosensitive member onto an image receiving member;

an auxiliary charging member provided downstream of said transferring device and upstream of said charging device with respect to a rotational movement of said photosensitive member;

a voltage applying device for charging toner remaining on said photosensitive member after the transfer of the toner image onto the image receiving member by said transferring device, and for applying, to said auxiliary charging member, a bias voltage effective to collect the polishing particles, which are charged to the polarity opposite the regular charging polarity of the toner, deposited on said photosensitive member; and a controller for controlling, on the basis of an image ratio, execution of a mode an operation in which said voltage applying device applies, to said auxiliary charging member, a bias voltage which is different from that during a image forming operation and which is effective to discharge, to said photosensitive member, polishing particles collected by said auxiliary charging member during non-image-formation.

2. An apparatus according to claim 1, wherein during the discharging mode, a potential difference between a charging potential and a developing bias is larger than a potential difference between a charging potential and a developing bias during the image formation.

3. An apparatus according to claim 1, wherein to said auxiliary charging member, a voltage of a potential identical to the normal charge polarity of the toner is applied during the image formation and a voltage of a potential opposite to the normal charge polarity of the toner is applied during the discharging mode.

4. An apparatus according to claim 1, wherein the polishing particles are strontium titanate particles which have an average primary particle size of 30 nm or more and 300 nm or less, a cubic or rectangular parallelepiped particle shape, and perovskite crystal.

5. An apparatus according to claim 1, wherein during the non-image-formation period, said controller controls, on the basis of the image ratio, the execution of the mode in which while applying the bias for supplying the polishing particles to said photosensitive member to said developing device, said applying device applies the bias of the same polarity as the regular polarity to said auxiliary charging member to supply the abrasion particles to said auxiliary charging member from said photosensitive member.

6. An apparatus according to claim 1, wherein the image ratio is a ratio of an area to be covered by the toner in an image formation area, and wherein said controller controls the execution of the mode, on the basis of the ratio, during the non-image-formation period in a job to discharge the polishing particles from said auxiliary charging member.

* * * * *